US006057816A

United States Patent [19]

Eckersley

[11] Patent Number: 6,057,816

[45] Date of Patent: May 2, 2000

[54] DISPLAY DEVICE DRIVING CIRCUITRY AND METHOD

[75] Inventor: Brian Eckersley, Manchester, United Kingdom

[73] Assignee: Digital Projection Limited, Manchester, United Kingdom

[21] Appl. No.: 08/716,173

[22] PCT Filed: Apr. 10, 1995

[86] PCT No.: PCT/GB95/00819

§ 371 Date: Oct. 24, 1996

§ 102(e) Date: Oct. 24, 1996

[87] PCT Pub. No.: WO95/28696

PCT Pub. Date: Oct. 26, 1995

[30] Foreign Application Priority Data

Apr. 13, 1994 [GB] United Kingdom ..... 9407302

[51] Int. Cl.[7] ..... G09G 3/34

[52] U.S. Cl. ..... 345/85; 345/84; 345/98

[58] Field of Search ..... 345/85, 86, 98, 345/149, 571, 88, 95

[56] References Cited

U.S. PATENT DOCUMENTS

| | | | |
|---|---|---|---|
| 4,745,485 | 5/1988 | Iwasaki | 345/88 |
| 5,214,417 | 5/1993 | Yamazaki | 345/95 |
| 5,278,652 | 1/1994 | Urbanus et al. | 345/85 |
| 5,298,915 | 3/1994 | Bassetti, Jr. | 345/571 |
| 5,506,597 | 4/1996 | Thompson et al. | 345/85 |
| 5,548,301 | 8/1996 | Kornher et al. | 345/85 |
| 5,581,272 | 12/1996 | Conner et al. | 345/149 |

FOREIGN PATENT DOCUMENTS

| | | |
|---|---|---|
| 0 610 655 A1 | 8/1994 | European Pat. Off. . |
| 92/09065 | 5/1992 | WIPO . |

*Primary Examiner*—Steven J. Saras
*Assistant Examiner*—Alecia D. Nelson
*Attorney, Agent, or Firm*—Michael J. Turton, Esq.; Dean W. Russell, Esq.; Kilpatrick Stockton LLP

[57] ABSTRACT

A method and apparatus for driving a display device including a matrix array of deflectable mirror devices is described. The deflectable mirror devices are divided into blocks of N rows. Selected groups of mirror devices within each block are loaded with single bit data in a cycle of loading operations During at least some of the loading operations, two series of reset cycles are used enabling one single bit cycle in one group to terminate and another single bit cycle in another group to commence within a single loading operation. Active bit data may be loaded and displayed in the otherwise unused time intervals between the active bits.

17 Claims, 7 Drawing Sheets

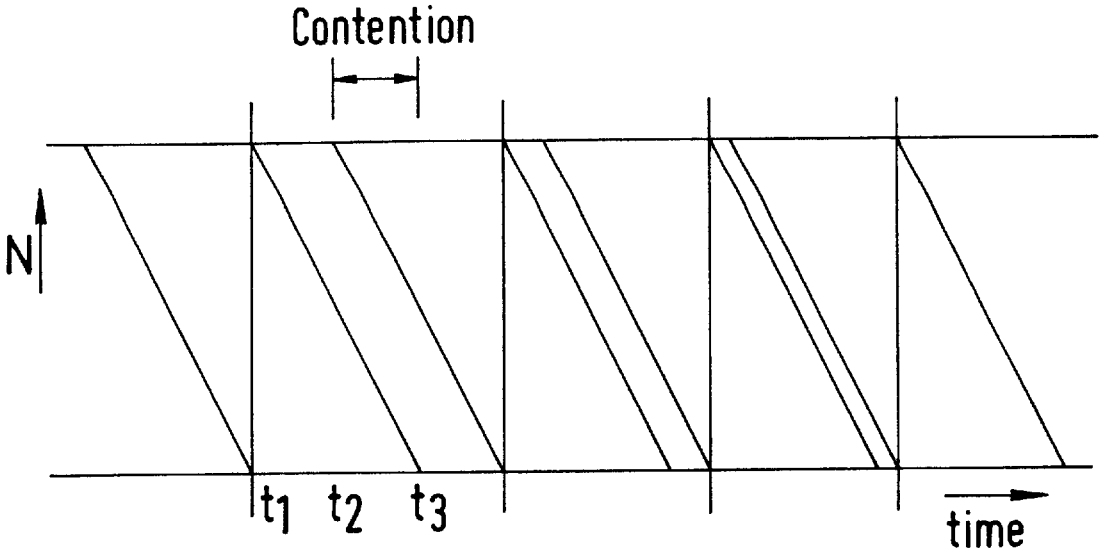
FIG. 6
FIG. 7a
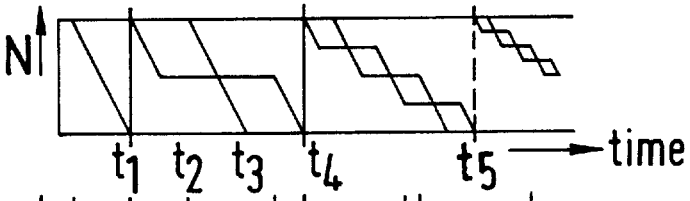
FIG. 7b
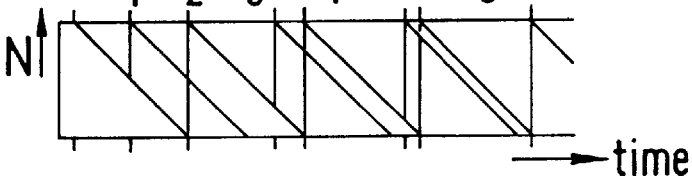

DISPLAY DEVICE DRIVING CIRCUITRY AND METHOD

CROSS-REFERENCES TO RELATED APPLICATIONS

The present application is being filed as the national phase of International Application PCT/GB95/00819 filed Apr. 10, 1995 and published as WO95/28696.

FIELD OF THE INVENTION

This invention relates to display devices and more particularly to circuits and methods for driving display devices. The invention particularly relates to display devices including a matrix array of switchable elements, each switchable element being switchable between at least two states, the form of the image displayed by the display device being dependent on which state each switchable element of the array is in.

BACKGROUND OF THE INVENTION

Such switchable elements may take the form of spatial light modulators which spatially modulate light from a light source, the spatially modulated light being projected onto a display screen to produce a displayed image. Examples of spatial light modulators include deflectable mirror devices as, for example, described in "Deformable Mirror Spatial Light Modulators" by Hornbeck, published in the Proceedings of SPIE, Vol. 1150, August 1989. Such deflectable or "deformable" mirror devices (DMDs) include an array of switchable mirror devices, each mirror device being mounted on a torsion element over a control electrode. Applying an electric field between each mirror device and the electrode causes the mirror device to pivot, thus changing the direction of light reflected from the mirror device.

Another example of a spatial light modulator is a liquid crystal device.

Alternatively, the matrix array of switchable elements may take the form of an array of light sources which themselves can be switched either "on" or "off", as for example in an array of light emitting diodes.

Generally such display devices are digital devices, that is each switchable element of the display device is effective to switch the light passing from the element to the displayed image either "on" or "off" so as to produce either "white" or "black" pixels on the displayed image. It is, however, possible to display grey scale images by controlling the time for which each switchable element of the display device is in a state such that light from the element arrives at the displayed image, and using the integrating response of the eye of an observer who will perceive a grey scale image from the element.

An example of such an arrangement is described in GB 2014822 which discloses a display device incorporating an X-Y array of energizable light emitting devices. The display device described in GB 2014822 takes data in binary digital forms, for example via an 8 bit signal, the device being driven a line at a time in a number of periods during which the modulators may be "on" or "off". The "ton"/"off" state of each pixel during each time period is determined by the state of the corresponding bit of the digital input data.

Display devices incorporating spatial light modulators, for example in the form of deflectable mirror devices, operate in an analogous manner. In deflectable mirror devices, however, the entire pixel array is driven simultaneously in sympathy with the video source vertical scan rate.

For an 8-bit input video signal, the eight time periods within each display frame period are of different lengths corresponding to bits D0 to D7 of the input video signal. The length of the time period corresponding to the least significant bit (LSB) or D0 in the input signal for any particular frame is set at a predetermined value, the duration of the time period corresponding to the next to the least significant bit (D1) being twice as long as that corresponding to the LSB, and so on. Thus, the length of the time period corresponding to the most significant bit (MSB) or D7 in the input signal is 128 times that corresponding to the LSB. Provided that all the time periods are included within a display frame period of less than around 20 msecs duration, the eye of the observer will integrate the periods and respond as if to a single period having a level of brightness corresponding to the binary signal value. All the bits of the same significance are entered into the element of the array effectively simultaneously. At the end of each sub-frame period corresponding to a single bit of the input signal, a single reset signal is supplied to all the elements of the array simultaneously in order to switch the elements either into a rest position in some systems as for example described in our copending application WO 92/12506, or into the state determined by the next bit signal in other systems.

When the single bit data for all mirror elements is loaded into the DMD and displayed in a single mirror reset cycle operation, then any bit significances requiring a display time of less then this single bit data load time cannot support loading of the next data bit before it itself needs to be terminated. In this situation, loading of the next data bit can only be achieved by first setting the mirrors to the display "off" state at the end of the current display time, and only then starting to load the next data bit. Thus whilst the next data bit is loading, the projector has no useful display light output and is optically dead. This optical dead time results in a loss of optical efficiency.

In U.S. Pat. No. 5,673,060 (the contents of which are incorporated herewith by reference, there is described a method whereby the mirror elements are divided into individually resettable groups. Thus in a "split reset" drive system, the mirror element matrix is divided into blocks of N individually resettable rows, columns, or diagonals with corresponding rows, columns, or diagonals from each block being connected to the same reset line. The individual mirror rows, columns, or diagonals within each block can be loaded with data in any order and can have different bit weight sequences for each row, column, or diagonal. The timing of the loading is such that the duration from loading a given row, column, or diagonal from the first data bit to loading the same row, column, or diagonal with the next data bit is proportional to the significance of the first data bit.

In a practical deflectable mirror device, the data applied to the mirror element address electrodes is stored in a CMOS data latch fabricated in an underlying silicon substrate. Operating with a mirror bias voltage as described, for example in the Hornbeck article cited herebefore such that the mirror elements retain their angle of tilt independent of the address electrode status until the next reset signal is applied, the CMOS latches for the rows not currently being loaded serve only a passive role in the data load/mirror reset cycle. Thus, with such a split reset mirror drive system, it is possible to share a single row of latches between the N mirror row, columns, or diagonals such that the active reset line then determines which row, column, or diagonal of mirror (elements is updated from the CMOS data latch. This brings about a benefit in that a reduced number of active devices is required from which to fabricate the CMOS latches, and hence an improved substrate yield is achieved according to established rules of semiconductor fabrication.

A further advantage of such a split reset system is that for a block of N individually addressable rows, columns, or diagonals, then only one Nth of the single bit frame of data needs to be loaded at any one time. This amount of data can be loaded in one Nth the time of the total single bit data for a non-split reset system. Thus shorter basic bit intervals can be displayed, without the need for a data load dead time cycle during which the mirror displays "black" whilst the next bit data is loaded into the substrate latches. Thus, split reset offers the opportunity to improve the overall optical modulation efficiency by reducing the amount of data load dead time required.

Conversely, a disadvantage of such a split reset mirror addressing scheme is that there is additional scope for image artefact generation as described in our co-pending international patent application GB93/02129. These artefacts arise as a result of relative motion between the displayed image and the observer interacting with the temporal displacements between displayed bit intervals of the same bit significance on nearby pixels. Where split reset is used, this results in the appearance of so-called "scalloping" artefacts running along lines displayed at right angles to the split reset rows, columns, or diagonal lines of mirrors.

However, the use of a split reset mirror addressing scheme does allow operation with smaller bit display intervals without the penalty of optical dead time, and there is thus greater freedom for manipulating the displayed bit sequence in order to minimise artefact generation. Thus, overall, the advantages of split reset operation outweigh the disadvantages.

Once an optimumised bit weight sequence has been determined according to GB93/02129 so as to minimise image artefacts on a non-split reset type display, the degree of artefact degradation of a split reset type display can, in principle, be reduced by displaying the same bit weight sequence on each of the split reset rows. This is feasible until the total time required to load the data latch and reset the mirrors for all the reset rows exceeds the bit weight display duration. Once this occurs, then at some point within the bit load cycle, the same mirror reset cycle will be required to load and reset two rows of mirrors simultaneously in order to terminate the current bit on one row and start the equivalent bit on another row.

Furthermore, for an N row reset scheme, the total time required to load the data for all N rows will be the same as for the non-split reset case, that is the total time is limited by the DMD input data bus bandwidth. However, because the single data load and mirror reset of a non-split reset scheme has been converted into N separate data loads and mirror resets, the total mirror reset time for a split reset scheme will be increased by a factor N. Thus, a split reset system of the form disclosed in U.S. Pat. No. 5,673,060 will have a longer overall single bit load/mirror reset cycle time than the equivalent non-split reset system, and hence will have a degraded motion induced artefact performance.

BRIEF SUMMARY OF THE INVENTION

It is an object of the present invention to provide a split reset driving circuitry and method for use in a display device incorporating a matrix array of switchable elements wherein the optical modulation efficiency may be increased and wherein the problems of displayed image artefacts are alleviated.

According to one aspect of the present invention there is provided a method of driving a display device including a matrix array of switchable elements in response to a digital video input signal, comprising the steps of allocating the switchable elements into blocks, and loading selected groups of elements within each block with data in a cycle of loading operations, wherein during at least some of the loading operations a plurality of data load cycles are used enabling one cycle in one group to terminate and another cycle in another group to commence within a single loading operation.

According to a second aspect of the present invention, there is provided a method of driving a display device including a matrix array of switchable elements, comprising the steps of allocating the switchable elements into groups, and loading selected elements within each group with data in a cycle of loading operations, wherein parts of some of the data bits are stuffed into the unused display time between other of the bits.

Further aspects of the invention provide apparatus for performing a method according to either the first or second aspects of the invention.

According to a third aspect of the present invention there is provided an apparatus and method for driving a display device including a plurality of switchable elements in which data is loaded into the switchable elements in overlapping cycles.

According to a fourth aspect of the present application there is provided an apparatus and method for driving a display device comprises a plurality of switchable elements using a bit stuffing technique.

BRIEF DESCRIPTION OF THE DRAWINGS

A number of methods and apparatus in accordance with embodiments of the invention will now be described by way of example only with reference to the accompanying figures in which:

FIG. 6 illustrates a split reset address timing cycle of known form;

FIG. 7 illustrates *a*) an example of a split reset address cycle timing cycle, and *b*) an address cycle in accordance with the invention;

BRIEF DESCRIPTION OF THE PREFERRED EMBODIMENTS

SYSTEM OVERVIEW

Figure 1:
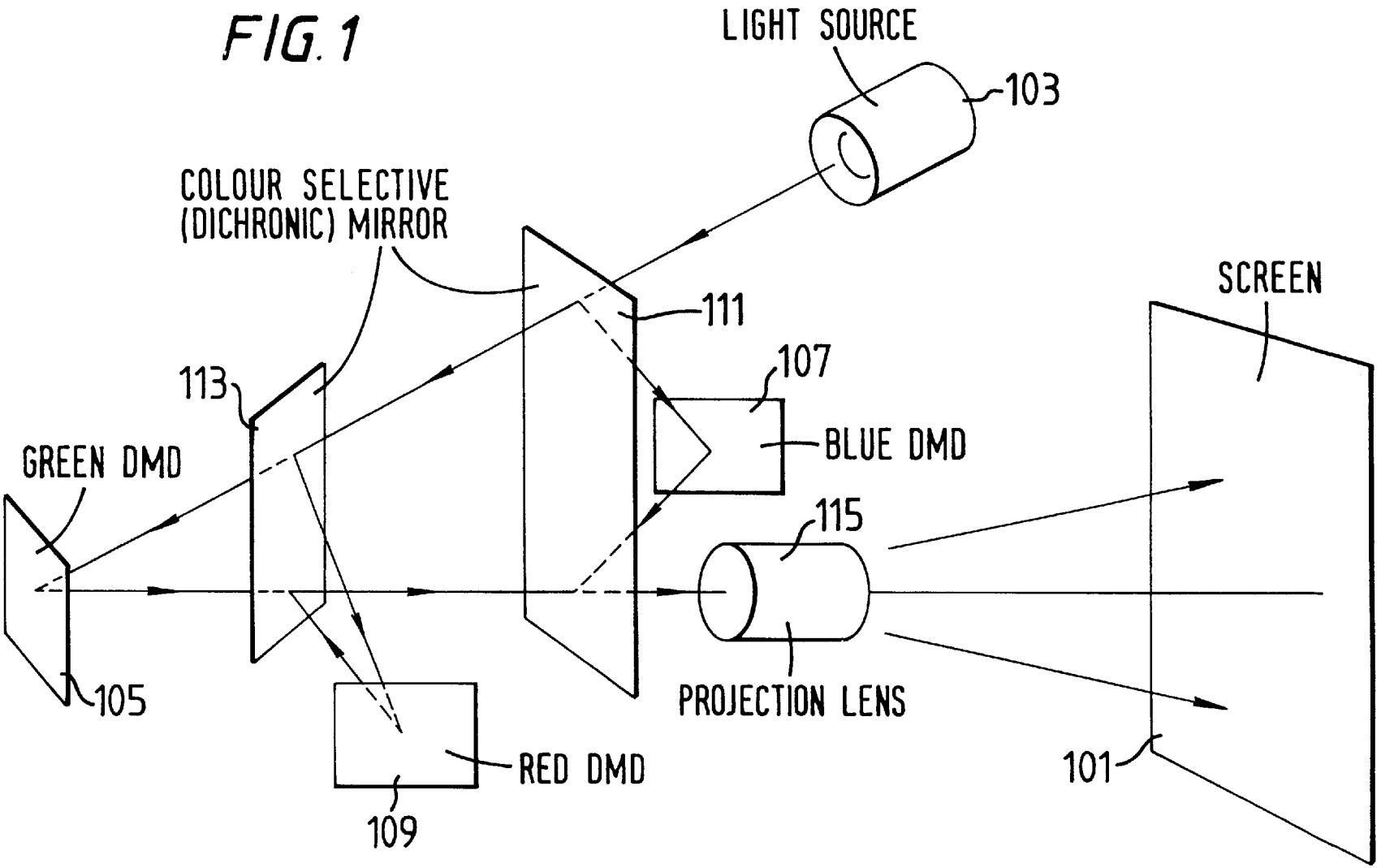
FIG. 1 is a schematic diagram of an overview of the optical system of a display system.

Referring firstly to FIG. 1, the particular example of a display system to be described is arranged to project a colour image onto a display screen 101. The display system includes a light source 103 which may take any suitable form, for example an arc lamp. The light source 103 is arranged such that the beam from the source is directed onto three planar deflectable mirror display devices 105,107,109 as will now be described.

Positioned in the light path between the light source 103 and the first deflectable mirror device 105 are two dichroic mirrors 111,113. The first dichroic mirror 111 is designed and angled to reflect blue light onto the second planar deflectable mirror display device 107 end transmit all other incident light. The second dichroic mirror 113 is designed and angled so as to reflect red light onto the third planar deflectable mirror device 109 and transmit the remaining green component of the light from the source 103 onto the first deflectable mirror display device 105.

The three deflectable mirror devices 105,107,109 are arranged to be capable of reflecting the three colour components of the beam from the source 103 so as to direct the spatially modulated beam through a projection lens 115 onto the display screen 101.

Figure 2:
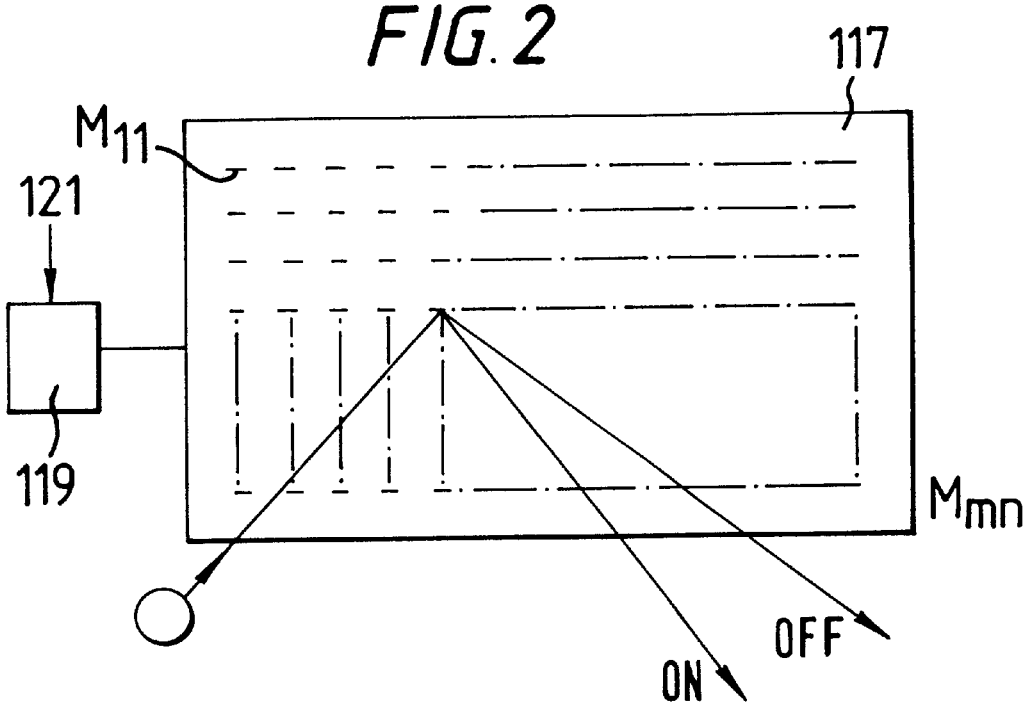
FIG. 2 is a schematic diagram of an array of deflectable mirror elements incorporated in the system of FIG. 1.
Figure 3:
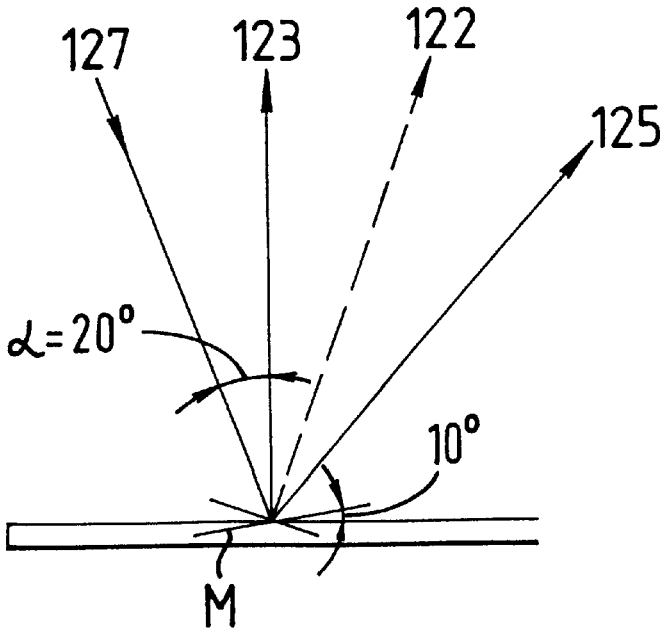
FIG. 3 illustrates the illumination of a mirror element in the array of FIG. 2.

Referring now also to FIGS. 2 and 3, each deflectable mirror device (DMD) 105,107,109 comprises an array of m×n deflectable mirror devices, typically 768×576 mirror devices for a low resolution display system or 1280×1024 mirror devices for a high resolution display system. Each array 117 is connected to a address circuit 119 which receives an electronic colour video signal from the control circuit indicated generally as 121, and addresses each of the mirror devices $M_{11}$-$M_{mn}$ as, for example, described in the applicant's earlier International Patent Application, PCT/GB92/00002 dated Jan. 4th 1992.

Dependent on the applied address signal, each mirror device M is caused to take one of two different positions corresponding to an "on" state in which the reflected light is directed in a first path 123 and an "off" state in which the reflected light is directed in a second path 125. The second path 125 is chosen such that light reflected along this direction is directed away from the optical axis of the display system into a beam dump (not shown) and thus does not pass into the projection lens 115 and onto the display screen 101.

Thus, each DMD array 117 is capable of representing a two dimensional image, those mirror devices M which are tilted to the "on" state appearing bright and those which are tilted to the "off" state appearing dark. By varying the ratio of the "on" period to "off" period, that is by a temporal modulation technique, grey scale can be achieved as will be described in more detail hereafter.

Turning now particularly to FIG. 3 the angle through which each mirror device M is deflected between the "on" state and the "off" state is relatively small. Thus in order to achieve good discrimination between the "on" and "off" states the incident light beam 127 from the source 103 is directed towards each spatial light modulator 105,107,109 at an angle measured from the normal to each device of around 20°.

When an individual mirror device M is lying parallel to the plane of the array 117, the incident beam 127 is reflected at a corresponding angle of 20° to the normal along an "off" path 122 into the beam dump. When the control signal from the address circuit 119 sets the mirror device M into a first deflection state constituting a "rest" orientation as will be explained hereafter, at a first angle to the plane of the array 117, the incident beam 127 is reflected along the direction 125 in a further "off" path into the beam dump. When the control signal from the address circuit 119 sets the mirror device M into a second deflection state at a second angle to the plane of the array 117, the incident beam 127 is reflected out along the normal to the array along the "on" path 123.

SPLIT RESET ADDRESSING

Figure 4:
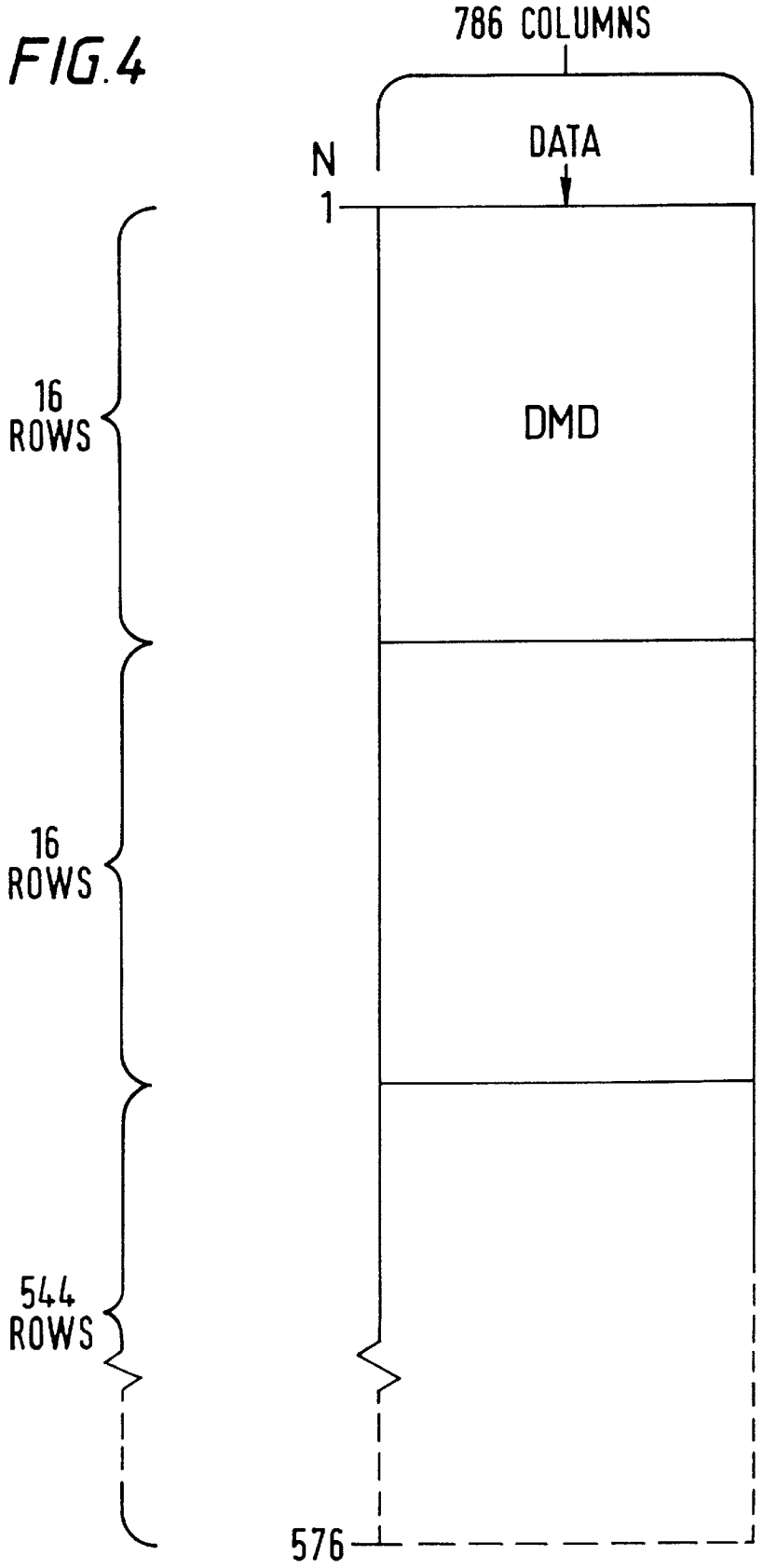
FIG. 4 illustrates the principle of operation of a split reset address system.
Figure 5:
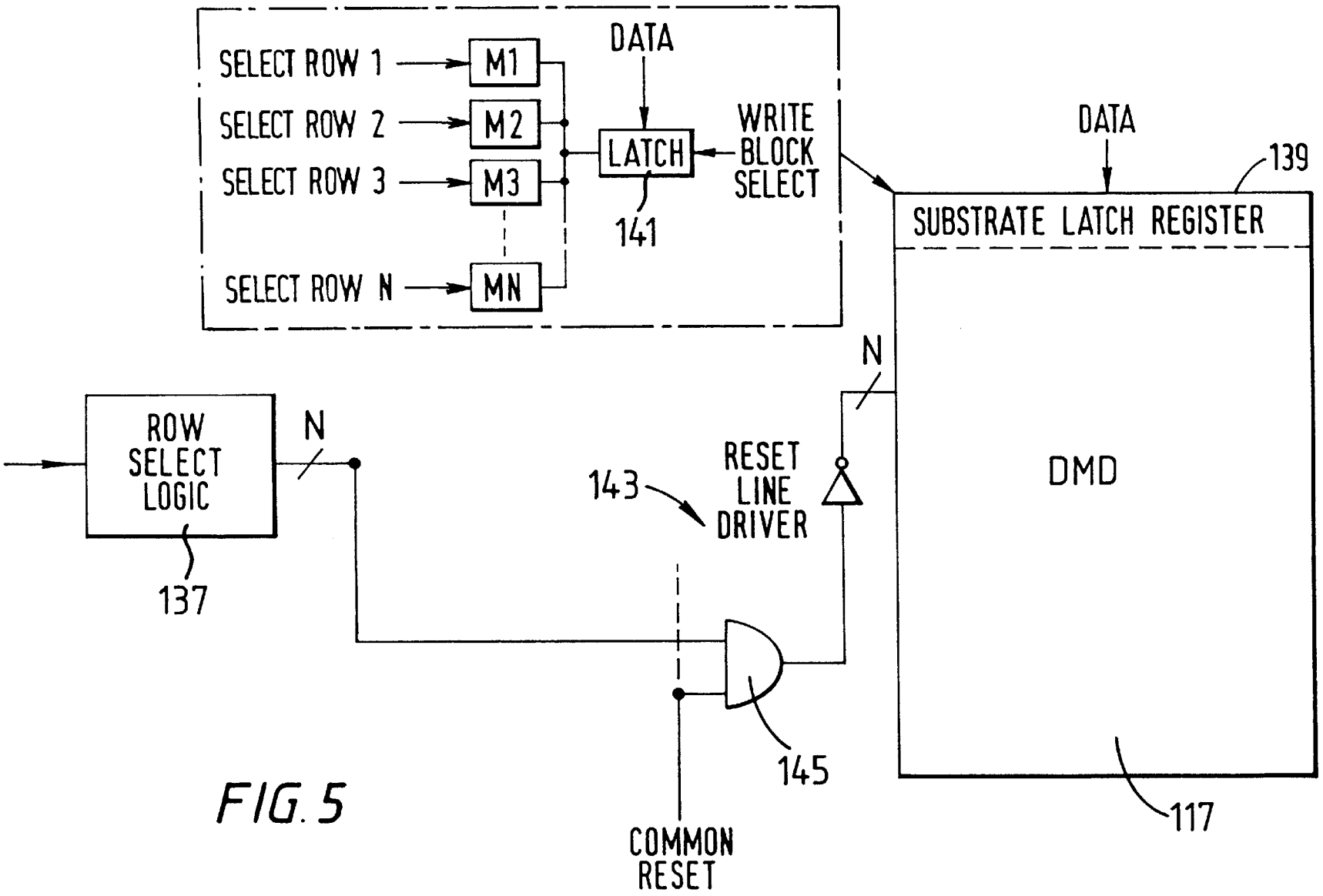
FIG. 5 is a block schematic diagram illustrating part of the electrical addressing circuitry for the array of deflectable mirror elements of FIG. 2.

Turning now to FIG. 4 this figure illustrates the operation of a split reset address system in which the array 117 is divided in the vertical direction into block of N rows (in the particular example shown, N=16) with the reset lines for equivalent rows from each block being connected in parallel. Referring now also to FIG. 5, row select logic 137 selects the rows of the DMD array 117 to be selected at any particular time. Each block of display rows of the array 117 has associated with it a latch register 139, which will be described in more detail hereafter. Each latch register 139 contains one data latch 141 for each mirror element M in a display row, and is fabricated in the underlying silicon CMOS substrate of the DMD. Since each display row in a block has its own independent reset driver 143 including a gate 145 to which row select pulses are applied at the appropriate times by the row select logic 137, it is possible to share a single CMOS data latch 139 between the N rows, each data latch 141 being shared between equivalent mirror elements M1 to MN in the N rows. This can be seen in the inset to FIG. 5 which illustrates a single data latch 141 of the latch register 139.

Turning now to FIG. 6, when displaying bit intervals having a display time less than the total single bit load cycle time, a conflict will occur when the same load/reset cycle is required both to terminate the current bit display interval on one row and to initiate a new display interval on another. This situation is shown during the time interval labelled "contention" in FIG. 6 which illustrates the loading of the N data rows as a function of time. It will be seen that during this time interval, the single bit load cycle initiated at time $t_1$ has only progressed partway through the N rows before it becomes necessary to start terminating the earlier loaded bits at time $t_2$. Thus, during the interval from $t_2$ to $t_3$ there is a period of contention when a single load/reset cycle is required to terminate a bit display interval on one row and initiate a bit display interval on another row.

One way of overcoming this problem of "contention" would be to load as many as possible of the N display rows within the bit display time of row 1 before terminating these bit intervals starting from row 1 again. The bit load cycle would then continue from the next available row until the bit display time is reached before returning to the same row to start terminating the bit intervals. This would continue until all N rows have been loaded as illustrated in FIG. 7*a*. The main disadvantage of such a system is that the changes from "initiating" to "terminating" and back again result in significant step discontinuities in the motion induced scalloping on displayed edges at right angles to the reset rows. It can be seen from FIG. 7*a* that as the length of the displayed bit interval decreases (for example from times $t_4$ and $t_5$ onwards), the number of discontinuities increases although their amplitude decreases.

An alternative approach is to define a load operation as containing two or more data load/mirror reset cycles such that a "short" bit interval on a particular row can only be initiated on the first load/reset cycle, whilst a short bit interval on the same or another row can only be terminated on the second load/reset cycle of the same or subsequent load/reset cycles. The effect of such a scheme is illustrated in FIG. 7*b* where it can be seen that the discontinuities of the single load/reset cycle scheme have gone. Furthermore, for a double load/reset cycle scheme, when both load/reset cycles are not being used such as occurs between consecutive "short" bits, then these bits can be overlapped as illustrated in FIG. 7*b* until either all the first load/reset cycles are in use, or all the second load/reset cycles are in use. Whilst the above optimises display of the "short" bit intervals, it can be seen that it now takes twice as long to load a "long" bit not requiring early termination onto the mirrors. This will double the motion induced "scallop" artefact amplitude perceived by the viewer.

A compromise is to employ a hybrid approach involving single load/reset cycles for the "long" bit intervals when the bit display time exceeds the time to load all N rows, and double load/reset cycles for the shorter bit display intervals. A further compromise will be required when the required bit display interval is shorter than that capable of being displayed by a double load/reset cycle scheme, in which case single load/reset cycles will have to be used. Under these conditions, the perceived motion induced discontinuities will be many but of low amplitude and, being confined to the least significant bit weights, will be much less obtrusive in the displayed image.

LATCH OPTIONS

Figure 8A:
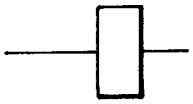
FIG. 8 illustrates, schematically, *a*) a single latch, *b*) a shadow latch and *c*) an A-B latch.
Figure 8B:
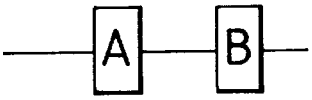
Figure 8C:
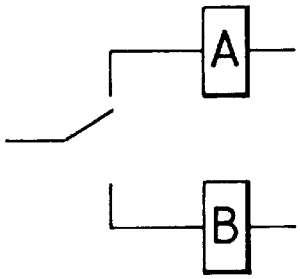

The overall performance of a split reset system is governed by the design of the latch register, and in particular by the design of the individual register latch elements for which a number of options are illustrated in FIG. 8. The individual latch register elements can be fabricated either as a single latch (FIG. 8*a*), a shadow or master-slave type double latch (FIG. 8*b*), or as an A-B or parallel type double latch (FIG. 8*c*).

Figure 9A:
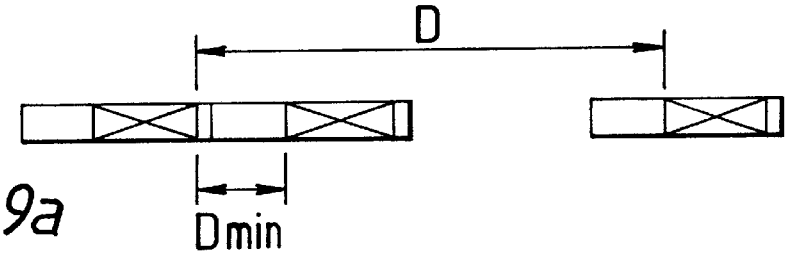
FIGS. 9*a*) *b*) and *c*) illustrate address timing cycles for the three different latch configurations of FIG. 8.
Figure 9B:
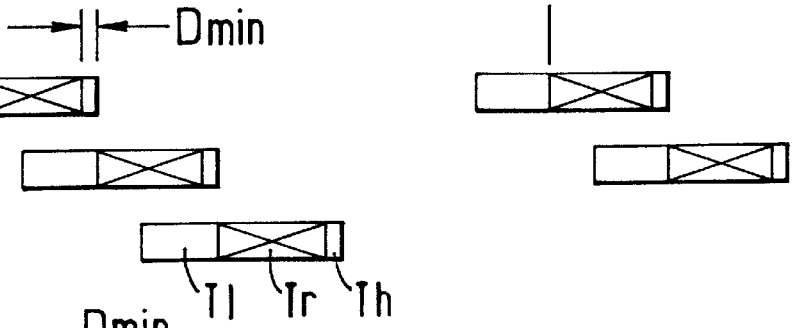
Figure 9C:
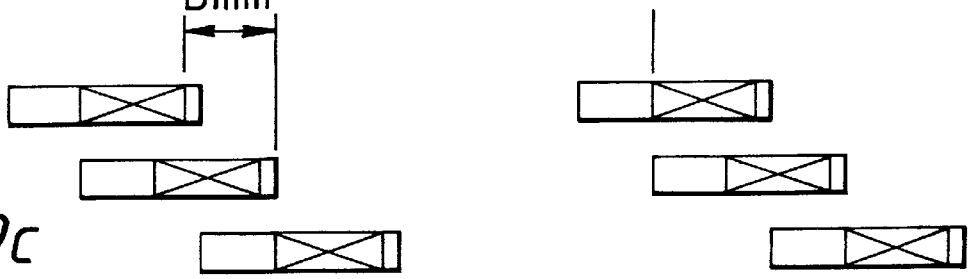

FIG. 9 illustrates the corresponding data load/mirror reset cycle time for the three different types of latch design for both a general (D) and the minimum (Dmin:, bit display duration. In FIG. 9 the latch data load/mirror reset cycle is defined as the data load time T1 plus the mirror reset cycle time Tr plus a data hold time Th during which the latch data must remain valid whilst the mirrors finally settle. Operating speed, or minimum bit display interval can be further improved by adding additional latches although this offsets the semiconductor substrate yield advantages of a reduced number of data latches brought about by the use of a split reset system.

For a given DMD, the data load time T1 is determined by the number of split reset lines N and the data bus bandwidth between a frame store, which will be described hereafter, and the array 117.

The mirror reset cycle time Tr is determined by the mechanical mirror response characteristic, whilst the data hold time Th is essentially a guard buffer time to accommodate spreads in mirror response times.

A comparison summary between the three latch options is given in Table 1, in which the mirror bit interval display cycle time is defined as the sum of bit interval duration D and the mirror reset cycle time Tr, the minimum display time, Dmin, is as illustrated in FIG. 9, whence the minimum load cycle time, Lct, for a single reset row and the minimum bit cycle time, Bct, for all N rows may be computed.

TABLE 1

| Parameter | Single Latch | Shadow Latch | A-B Latch |
|---|---|---|---|
| Display Cycle Time, | D + Tr | D + Tr | D + Tr |
| Min Display Time, Dmin | Tl + Th | Th | Tl + Th |
| Min Load Cycle Time, Lct | Tl + Tr + Th | Tr + Th | Tl + Tr + Th |
| Min Bit Cycle Time, Bct | N(Tl + Tr + Th) | N(Tr + Th) | N(Tl + Tr + Th)/2 |

It can be seen from Table 1 that the A-B latch, when considered over all N reset lines, is twice as fast as the single latch and will therefore have half the motion induced scallop amplitude of a single latch. The shadow latch system lies between the single latch and A-B latch configurations in terms of overall speed over N reset lines. However, a shadow latch is capable of displaying a smaller bit interval on a single mirror than is the A-B latch configuration. Thus shadow and A-B latches offer a choice between maximum greyscale resolution using a shadow latch, or minimum scallop artefacts using an A-B latch.

"BIT STUFFING"

A consequence of a split reset row by row mirror addressing scheme, is that only one Nth of the bit frame data has to be loaded into the DMD substrate prior to applying a reset signal to the appropriate reset line. Thus, with the appropriate choice of N, the required latch data load time can be reduced below the critical value above which data load dead time cycles are required. Whilst the shortest bit display time can be arranged to enable loading of the data for the next display bit, longer bit intervals should ideally have a display time longer that the load and display cycles for the other reset groups of mirrors M. It becomes possible when displaying the smallest bit intervals on a split reset system to load and to display real data during the time intervals between the active bits. Stuffing active bit data into these otherwise unused and therefore optically dead time intervals allows the display system optical modulation efficiency to be increased, and provides an additional bonus in the form of an additional degree of freedom in optimising the bit weight display sequence to reduce motion induced display artefacts.

In order to avoid the data load/mirror reset cycle contention described in relation to FIG. 6, only bit weights whose display intervals are longer than the "stuff" intervals can be employed for bit stuffing. Any active bit time stuffed into these time slots must then be subtracted from the normal bit display intervals for that bit weight. For motion induced artefacts it may be beneficial to employ high order bits such as the MSB or MSB−1 for bit stuffing as the increased number of bit intervals will provide improved scintillation artefact performance.

Since the total mirror reset cycle time for all N rows increases in proportion to the value of N, it follows that once the minimum value of N required to eliminate the need for data load dead time has been reached, any further increase in N only serves to degrade the motion induced image artefact performance by extending the bit cycle time. Referring again to FIG. 9, the maximum latch data load time must be less than the sum of the reset cycle time Tr and the data hold time Th if the data load/mirror reset cycle is not to be load time limited. However, in the case of an A-B latch, the minimum bit interval display time is a function of the latch data load time, and hence increasing the value of N to reduce the minimum bit interval display time must be balanced against the resulting increase in motion induced image artefacts. Thus, if minimum bit interval display time is the prime concern, then a shadow latch scheme is preferable to A-B latch when the minimum bit interval display time drops below the sum of the reset cycle time Tr and twice the data hold time Th.

The bit stuffing technique is equally applicable to the previously described split reset schemes employing single, double, or hybrid single/double data load/mirror reset cycles per data load operation. However, from FIG. 9 it can be seen that in the case of a double load/mirror reset cycle shadow latch scheme, the minimum bit interval display time increases to the sum of the mirror reset cycle time Tr, plus twice the data hold time Th. For bit interval display times of less than this value but greater than the data hold time, then single data load/mirror reset cycles must be used. In practice, this will not unduly affect motion induced artefacts performance since it is only the least significant bits which are affected, and the resulting scallop artefact discontinuities whilst numerous will be of low amplitude.

IMPLEMENTATION OF DOUBLE RESET AND BIT STUFFING

Figure 10:
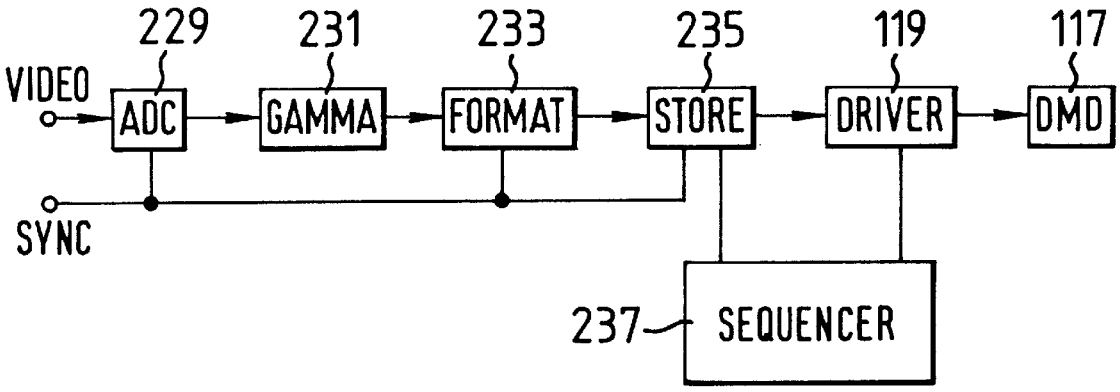
FIG. 10 illustrates schematically part of the display system used to implement an addressing system in accordance with an embodiment of the invention.
Figure 11:
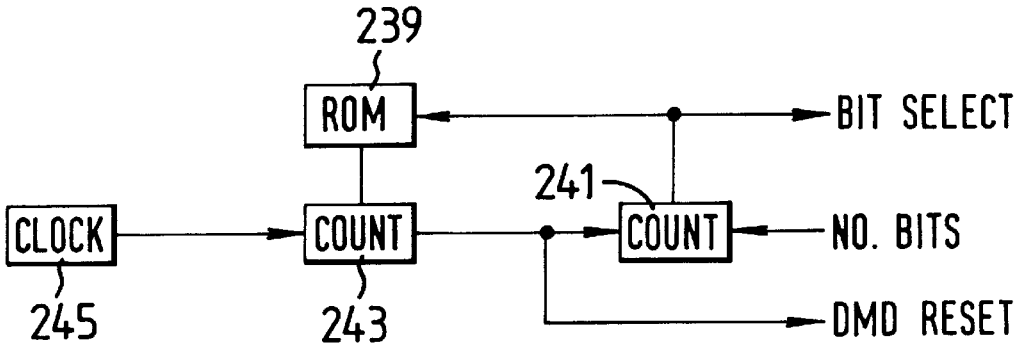
FIG. 11 illustrates schematically the sequencer incorporated in the system of FIG. 10.
Figure 12:
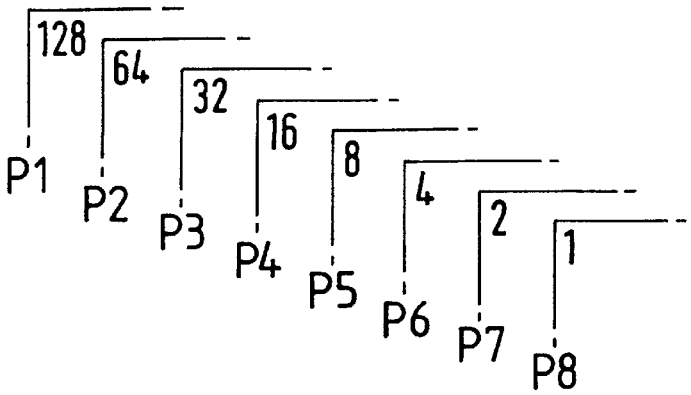
FIG. 12 illustrates schematically a frame store incorporated in the system of FIG. 10.

Referring now to FIGS. 10, 11 and 12, these figures illustrate an example of addressing circuitry for implementing modified addressing schemes in accordance with the invention.

Referring firstly particularly to FIG. 10, the video input signal, which consists of one of three separate video signals representing the red, green and blue colour components of the image to be displayed, is applied to an analogue to digital converter (ADC) unit 229 together with a synchronising signal. The output of the ADC unit 229 is applied to a gamma correction unit 231 to remove the gamma correction which is normally applied to video signals for display on a cathode ray tube.

The output of the gamma correction unit 231 is applied to a data formatting unit 233 to convert the word serial video input into a form suitable for addressing the DMD array 117. The data formatting unit 233 is arranged to address alternately two frame stores 235, of which only one is illustrated in FIG. 10. Each frame store 235 is arranged to store the video data for each element M of the DMD array 117, and to supply this data to each element M within the DMD array 117 via the driver circuit 119. The form of the frame stores 235 will be described in more detail hereafter.

A sequencer 237, whose form will be described in more detail hereafter, is arranged to supply the reset signals to the mirror devices in the DMD array 117 at the end of each bit frame display interval so as to enable all the mirror devices M to assume the "rest" orientation illustrated in FIG. 3 prior to being deflected into their next required orientation relative to the illuminating beam. Whilst one frame store 235 is supplying data to the DMD array 117, the other frame store 235 is receiving fresh video data from the data formatting unit 233.

Turning now particularly to FIG. 11, the sequencer 237 includes a read only memory (ROM) 239 programmed with the display time lengths of each bit field. The ROM 239 is addressed by a programmable counter 241 which is clocked by the output of a second programmable counter 243 which is, in turn, clocked by clock pulses from a clock 245. Counter 243 is programmed such that the total number of counts produced within each frame time is determined by a preset value obtained from the ROM 239. The count cycle of counter 243 thus defines the display time duration for the current bit weight, whilst counter 241 cycles through each bit display interval making up a complete display cycle. The output of counter 241 also defines the next bit weight to be transferred from the relevant frame store 235 to the DMD array 117.

At the end of each display interval, counter 243 generates an output signal which resets the DMD array 117 and transfers the new information to the mirror devices M, presets itself with next bit frame display time, and finally increments counter 241 to select the next bit weight.

Turning now particularly to FIG. 12 and assuming an 8 bit video input signal, each frame store 235 includes 8 planes P1, P2 . . . P8. Each plane holds data for DMD array 117 corresponding to a single bit weight of the input video signal. Thus, plane P1 corresponds to the MSB D7, plane P2 corresponds to the next most significant bit D6 and so on up to P8 which corresponds to the LSB D0. The sequencer 237 provides appropriate control signals to each frame store 235 to write a single bit plane of data into the DMD array 117 ready for display during the next bit display interval using either a single split reset scheme, a double split reset scheme or a hybrid of these two, and incorporating bit stuffing as appropriate. The net result is that each mirror device M of the DMD array is reset in a suitable time multiplexed manner.

Implementation of bit address schemes in accordance with the invention is achieved by suitable programming of the sequencer ROM 239, and setting the number and sequence of bits to suit the new sequence. The distribution of the input bit weights between the additional display intervals is achieved within the gamma corrector 231 by modifying the look-up table, which is generally incorporated within the gamma corrector, to increase the output bus width.

ALTERNATIVE EMBODIMENTS

It will be appreciated that whilst the particular display device described herebefore by way of example relates to a display device including three deflectable or deformable mirror devices, the invention is equally applicable to other forms of display device including other forms of digitally addressed spatial light modulators such as liquid crystal devices, and also to display devices which incorporate an array of switchable light sources.

It will also be appreciated that whilst in the particular embodiment described, the grey scale is achieved totally by means of time division modulation of the switchable elements, the invention is also applicable to display systems in which part of the grey scale is achieved by binary modulation of the light source. Such a display system is described, for example, in the applicant's copending International Patent Application No. GB93/02254.

It will also be appreciated that whilst the particular colour display system describe herebefore by way of example incorporates three separate light modulators 105,107,109, one for each primary colour, for example red, blue and green the modulators operating in parallel, the invention is equally applicable to sequential colour display systems employing a colour wheel or similar device for changing the colour of the light in a controlled manner. In such a sequential colour system, the colours are displayed sequentially from a single light modulator such that light from each colour is temporally displaced by one third of a display frame period.

I claim:

1. A method of driving a display device including a matrix array of switchable elements, each switchable element being effective to direct light representative of a pixel of an image towards a display in response to the loading of portions of an input image signal comprising a series of data bits representative of successive image frames, data bits of different significance representing different display periods, the duration of each display period being proportional to the brightness of light at each pixel of the displayed image, the method comprising the steps of:

applying reset signals enabling the loading of groups of elements within a block within said matrix array of switchable elements with data bits of the same significance and subsequent termination of the display periods in a series of successive data loading operations until all the groups of switchable elements have been loaded with data bits of the same significance; and repeating said series of successive data loading operations for all the different significance data bits until all switchable elements in the block have been loaded with data bits of all significances for each image frame;

wherein:

during at least some of the series of data loading operations, for data bits of a first significance each switchable element within each group is loaded with data bits in response to a first series of reset signals;

each display period for each switchable element in the group is terminated in response to a second series of reset signals, the signals of the second series being interposed between the signals of the first series; and the loading of data bits of a different significance to the first significance commences after the first series of reset signals have been used to cause data of the first significance to be loaded in all groups in the block and before the end of the display period for the data bits of the first significance for all the groups in the block.

2. A method according to claim 1 in which said method is used where the time for loading all groups of the block with the bit data of the first significance using a single series of reset signals to both load data bits and terminate display periods is greater than the display period for the data bit.

3. A method of driving a display device including a matrix array of switchable elements, each switchable element being effective to direct light representative of a pixel of an image towards a display in response to the loading of portions of an input image signal comprising a series of data bits representative of successive image frames, data bits of different significance representing different display periods, the duration of each display period being proportional to the brightness of light at each pixel of the displayed image, the method comprising the steps of:

loading groups of said switchable elements within a block of switchable elements with data bits of the same significance in a series of successive data loading operations until all the groups of switchable elements have been loaded with data bits of the same significance; and repeating said series of successive data loading operations for all the different significance data bits until all said switchable elements have been loaded with data bits of all significances for each image frame;

wherein:

in at least some of the time intervals between the termination of the display periods for data bits of a significance corresponding to a first display period of less than the load time for loading all the groups with data bits of said significance corresponding to the first display period and the commencement of the loading of the next data bits, and the time intervals between the termination of the previous data bits and the commencement of the display periods for data bits of a significance corresponding to said first display period, parts of the display periods for chosen data bits of a significance corresponding to a second display time of longer than the load time for loading the chosen data bits of said second significance in all the groups of switchable elements are displayed.

4. A method according to claim 1 or 3 in which the matrix array of switchable elements comprises a deflectable mirror device.

5. A method according to claim 1 or 3 in which each group comprises one or more rows or columns or diagonals of switchable elements in the matrix array.

6. A method according to claim 1 or 3 in which said array comprises a plurality of said blocks of switchable elements, corresponding groups in each block being loaded with data bits of the same significance at the same time.

7. A method according to claim 1 using a latch register associated with the block of switchable elements, the latch register containing one data latch for each switchable element of a group within the block, wherein the data latches are single data latches.

8. A method according to claim 1 or 3 using a latch register associated with the block of switchable elements, the latch register containing one data latch for each switchable element of a group within the block in which the data latches are master-slave type double data latches.

9. A method according to claim 1 or 3 using a latch register associated with the block of switchable elements, the latch register containing one data latch for each switchable element of a group within the block in which the data latches are parallel type double data latches.

10. An apparatus for driving a display device including a matrix array of switchable elements, each switchable element being effective to direct light representative of a pixel of an image towards a display in response to the loading of portions of an input image signal comprising a series of data bits representative of successive image frames, data bits of different significance representing different display periods, the duration of each display period being proportional to the brightness of light at each pixel of the displayed image, the apparatus comprising:

reset signal circuitry for applying reset signals to chosen groups of switchable elements within a block of switchable elements to enable loading of the chosen group of switchable elements and subsequent termination of the display periods;

data loading circuitry for loading groups of switchable elements to which the reset signals are applied with data bits of the same significance in a series of successive data loading operations until all the groups of switchable elements have been loaded with data bits of the same significance; and control circuitry for successively repeating said series of data loading operations for all the different significance data bits until all switchable elements in the block have been loaded with data bits of all significances for each image frame;

wherein:

said reset signal circuitry includes first reset circuitry effective to apply a first series of reset signals effective to load each chosen group with data bits of a first significance;

second reset circuitry effective to apply a second series of reset signals effective to terminate the display periods for each switchable element in each chosen group; and said data loading circuitry is arranged to load data bits of a different significance to the first significance after the first series of reset signals have been used to cause data of the first significance to be loaded in all groups of switchable elements in the block and before the end of the display period for the data bits of the first significance for all the groups of switchable elements in the block.

11. An apparatus for driving a display device including a matrix array of switchable elements, each switchable element being effective to direct light representative of a pixel of an image towards a display in response to the loading of portions of an input image signal comprising a series of data bits representative of successive image frames, data bits of different significance representing different display periods, the duration of each display period being proportional to the brightness of light at each pixel of the displayed image, the apparatus comprising:

loading circuitry for loading successive groups of elements within a block of switchable elements with data bits of the same significance in a series of data loading operations until all the groups of elements have been loaded with bit data of the same significance;

control circuitry for repeating said series of data loading operations successively for all the different significance data bits until all switchable elements in the block have been loaded with data bits of all significances for each image frame; and enabling circuitry for enabling the display in at least some of the time intervals between the termination of the display periods for data bits of a significance corresponding to a first duration less than the load time for loading all the groups with data bits of said significance corresponding to the first display period and the commencement of the loading of the next data bits, and the time intervals between the termination of the previous data bits and the commencement of the display periods for data bits of a significance corresponding to said first display period, of parts of the display periods for chosen data bits of a significance corresponding to a second display time longer than the load time for loading the chosen data bits of said second significance in all the groups of the block.

12. An apparatus according to claim 10 or 11 in which the matrix array of switchable elements comprises a deflectable mirror device.

13. An apparatus according to claim 12 in which each group comprises one or more rows or columns or diagonals of switchable elements within the matrix array.

14. An apparatus according to claim 10 or 11 in which said array comprises a plurality of said blocks of switchable elements, and said reset signal circuitry is arranged such that corresponding groups of switchable elements in each block are loaded with data bits of the same significance at the same time.

15. An apparatus according to claim 10 including a latch register associated with the block of switchable elements, each latch register containing one data latch for each switchable element of a group within the block, wherein the data latches are single data latches.

16. An apparatus according to claim 14 including a latch register associated with the block of switchable elements, each latch register containing one data latch for each switchable element of a group within the block, wherein the data latches are master-slave type double data latches.

17. An apparatus according to claim 14 including a latch register associated with the block of switchable elements, each latch register containing one data latch for each switchable element of a group within the block, wherein the data latches are parallel type double data latches.

* * * * *

UNITED STATES PATENT AND TRADEMARK OFFICE

CERTIFICATE OF CORRECTION

PATENT NO. : 6,057,816

DATED : May 2, 2000

INVENTOR(S) : Eckersley

It is certified that error appears in the above-identified patent and that said Letters Patent is hereby corrected as shown below:

Column 1, line 60, delete " "ton"/"off" " and replace with --"on"/"off"--.

Column 2, line 38, please replace "reference" with --reference)--.

Column 2, line 65, please delete the bracket before the word elements, as follows "(elements" should be --elements--.

Column 5, line 16, please delete "end" and insert --and--.

Column 7, line 40, please delete "(Dmin:" and insert --(Dmin)--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*